US009073331B2

(12) United States Patent
Shimamura

(10) Patent No.: US 9,073,331 B2
(45) Date of Patent: Jul. 7, 2015

(54) FLUID PATH STRUCTURE AND METHOD OF MANUFACTURING THE SAME

(71) Applicant: CANON KABUSHIKI KAISHA, Tokyo (JP)

(72) Inventor: Ryo Shimamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/287,497

(22) Filed: May 27, 2014

(65) Prior Publication Data

US 2014/0362144 A1 Dec. 11, 2014

(30) Foreign Application Priority Data

Jun. 5, 2013 (JP) ..... 2013-118856

(51) Int. Cl.

| | |
|---|---|
| ***B41J 2/05*** | (2006.01) |
| ***B41J 2/175*** | (2006.01) |
| ***B41J 2/16*** | (2006.01) |
| ***F15C 1/00*** | (2006.01) |
| ***B41J 2/14*** | (2006.01) |

(52) U.S. Cl.

CPC ..... *B41J 2/175* (2013.01); *B41J 2/1623* (2013.01); *F15C 1/008* (2013.01); *Y10T 156/10* (2015.01); *B41J 2/14024* (2013.01); *B41J 2/1601* (2013.01); *B41J 2/1632* (2013.01)

(58) Field of Classification Search

USPC ..... 347/56, 61, 65, 66, 67

See application file for complete search history.

(56) References Cited

U.S. PATENT DOCUMENTS

| | | | | |
|---|---|---|---|---|
| 5,900,894 | A * | 5/1999 | Koizumi et al. | 347/65 |
| 5,969,738 | A * | 10/1999 | Tomikawa et al. | 347/86 |
| 6,447,984 | B1 * | 9/2002 | Tatsumi et al. | 430/320 |
| 6,799,831 | B2 * | 10/2004 | Inamoto et al. | 347/44 |
| 8,388,114 | B2 * | 3/2013 | Yamaguchi et al. | 347/66 |

FOREIGN PATENT DOCUMENTS

JP 2007-007968 A 1/2007

* cited by examiner

*Primary Examiner* — Anh T. N. Vo

(74) *Attorney, Agent, or Firm* — Fitzpatrick, Cella, Harper & Scinto

(57) ABSTRACT

A fluid path structure is manufactured by way of an aligning step of aligning a first resin part with a second resin part by inserting a projection formed on the first resin part into a corresponding hole formed in the second resin part and a welding step of welding joint surfaces of the first resin part and the second resin part, thereby forming a fluid path. The aligning step is executed so as to narrow the gap between the projection and the hole to a minimum at a base side of the projection relative to a half of the height of the hole and the welding step is executed only at the base side of the projection relative to the half of the height of the hole so as to make the lateral surface of the projection only partially contact with the lateral surface of the hole.

8 Claims, 6 Drawing Sheets

| HEIGHT OF CONTACT PORTION RELATIVE TO HEIGHT OF HOLE | 1/4L | 1/2L | 3/4L | L |
|---|---|---|---|---|
| DEFLECTION OF PROJECTION | A | B | C | D |

FLUID PATH STRUCTURE AND METHOD OF MANUFACTURING THE SAME

BACKGROUND OF THE INVENTION

1. Field of the Invention

The present invention relates to a method of manufacturing a fluid path structure to be used for conveying liquid, which may typically be a fluid path structure to be used in an inkjet head.

2. Description of the Related Art

Structures having fluid paths for conveying fluid such as liquid or gas in the inside of the three-dimensional body thereof by covering a resin plate having grooves formed on the surface thereof by means of a flat resin plate bonded thereto are known. For example, a holder unit that is a component of a liquid ejection head such as a tank-mounted inkjet head is one of such structures.

Such a holder unit includes a resin-made holder and a fluid path forming member and is produced by welding them together at the opposite surfaces thereof. Grooves that become ink path and ribs to be welded that run along the grooves are arranged on the surface to be welded of the fluid path forming member. On the other hand, grooves are arranged at the positions opposite to the respective ribs on the surface to be welded of the holder. Ink paths are completed as the holder and the fluid path forming member are joined together typically by means of an ultrasonic welding method.

Generally, alignment means are arranged on a pair of resin members of the above-described type that are to be welded together in order to weld them properly. Japanese Patent Application Laid-Open No. 2007-007968 discloses an alignment structure for suitably aligning two members without interfering with the operation of welding the two members.

With an ultrasonic welding method, the resin members that have welding zones are brought into contact with each other and then fused at the welding zones and joined together by means of the frictional heat that is generated due to the vibrations and pressure applied to them. Particularly, in the case of welding a fluid path forming member to be used for conveying fluid, the member needs to be reliably fused and joined with the partner member at the welding zones thereof in order to achieve airtightness for the fluid paths.

Conventionally, a fluid path forming member to be used for an inkjet head having a holder unit is aligned in the above-described manner and welded to the partner member typically by ultrasonic welding to produce fluid paths in it. In such welding operations, the conventional welding technique has been acceptable even if the members to be welded contact with each other at areas other than the welding zones such as the alignment areas and/or one or more than one outer peripheral parts of the fluid path forming member.

However, if the number of color inks is increased and/or if larger fluid path forming members and/or more complicated ink paths are employed in the future, the vibration energy that is applied to the welding zones will be lost, if partly, at the contact area or areas while the welding operation is proceeding to consequently degrade the performance of the welding operation particularly at parts located near the contact area or areas, which results in liquid leakage.

SUMMARY OF THE INVENTION

According to the present invention, the above-identified problem is resolved by providing a method of manufacturing a fluid path structure including: an aligning step of aligning a first resin part with a second resin part by inserting a projection formed on the first resin part into a corresponding hole formed on the second resin part; and a welding step of welding joint surfaces of the first resin part and the second resin part that have been aligned, thereby forming a fluid path; the aligning step being executed so as to narrow the gap between the projection and the hole to a minimum at a base side of the projection relative to a half of the height of the hole; the welding step being executed only at the base side of the projection relative to the half of the height of the hole so as to make the lateral surface of the projection only partially contact with the lateral surface of the hole.

Further features of the present invention will become apparent from the following description of exemplary embodiments with reference to the attached drawings.

DESCRIPTION OF THE EMBODIMENTS

Figure 1A:
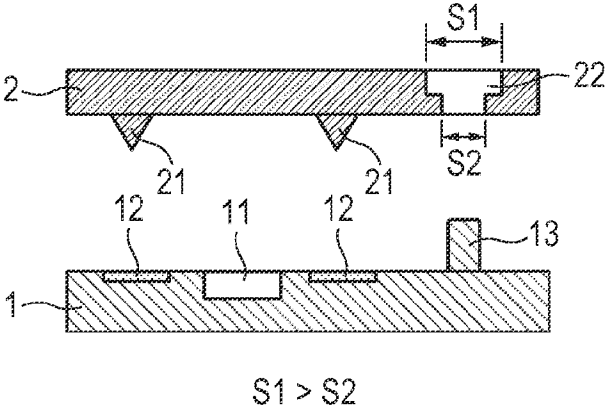
FIGS. 1A and 1B are schematic cross-sectional views of an embodiment of fluid path structure including welding zones and an aligning section according to the present invention.

Now, the present invention will be described in greater detail below by referring to the drawings that illustrate preferred embodiments of the invention.

First Embodiment

Figure 1B:
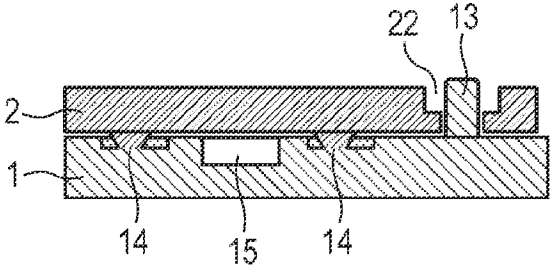

FIGS. 1A and 1B are schematic cross-sectional views of an embodiment of fluid path structure. The fluid path structure of this embodiment is formed by joining a first member to be welded (to be referred to as first weld member hereinafter) 1 and a second member to be welded (to be referred to as second weld member hereinafter) 2 together by means of ultrasonic welding. FIG. 1A is a cross-sectional view, representing the two weld members 1 and 2 before they are actually welded. As illustrated in FIG. 1A, a fluid path groove (ink path) 11 that is U-shaped in cross section and a plurality of welding grooves 12 that are arranged outside the fluid path groove 11 are formed in the first weld member from the surface (joint surface) thereof that is to be joined with the second weld member 2. Additionally, a projection 13 is also formed on the same surface of the first weld member 1 as integral part thereof.

On the other hand, a plurality of ribs 21 are arranged on the surface (joint surface) of the second weld member 2 that is to be joined with the first weld member 1. The ribs 21 are arranged at positions located vis-à-vis the corresponding welding grooves. Note that a welding groove that is to operate as part of the ink path may be formed between the ribs 21.

Ribs 21 to be used for the purpose of the present invention generally are triangular in cross section (see the cross-sectional view of FIG. 1A). In this embodiment, the ribs 21 have a base width of 1 mm, which is equal to the height thereof. A through hole 22 is formed in the second weld member 2 at a position that corresponds to the projection 13 so as to be able to capaciously receive the projection 13. With regard to the hole 22, note that the open area S2 thereof at the joint surface side is made smaller than the open area S1 thereof at the surface side opposite to the joint surface (S1>S2) and the area S2 (the cross-sectional area of the hole 22) is maintained for a part of the hole whose height is not greater than a half of the height of the second weld member 2. Also note that the expression of "the height of the hole" as used herein refers to the height thereof as measured from the joint surface of the member through which the hole is formed.

Figure 5:
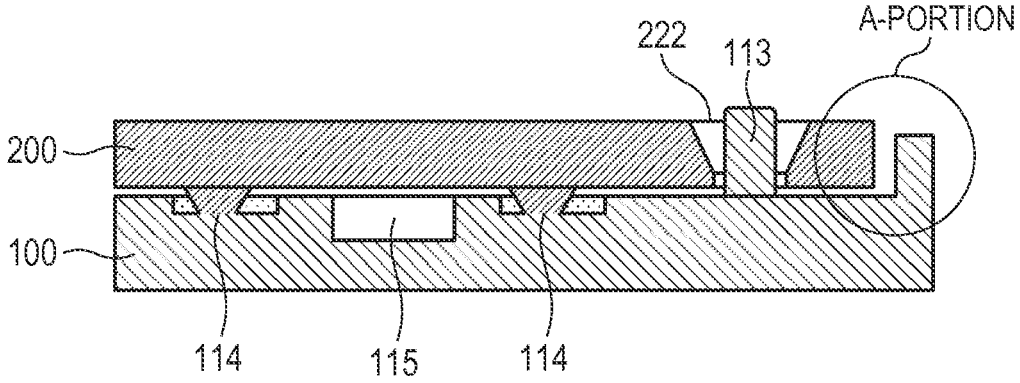
FIG. 5 is a schematic cross-sectional view of another embodiment of fluid path structure including welding zones and an aligning section according to the present invention.
Figure 6:
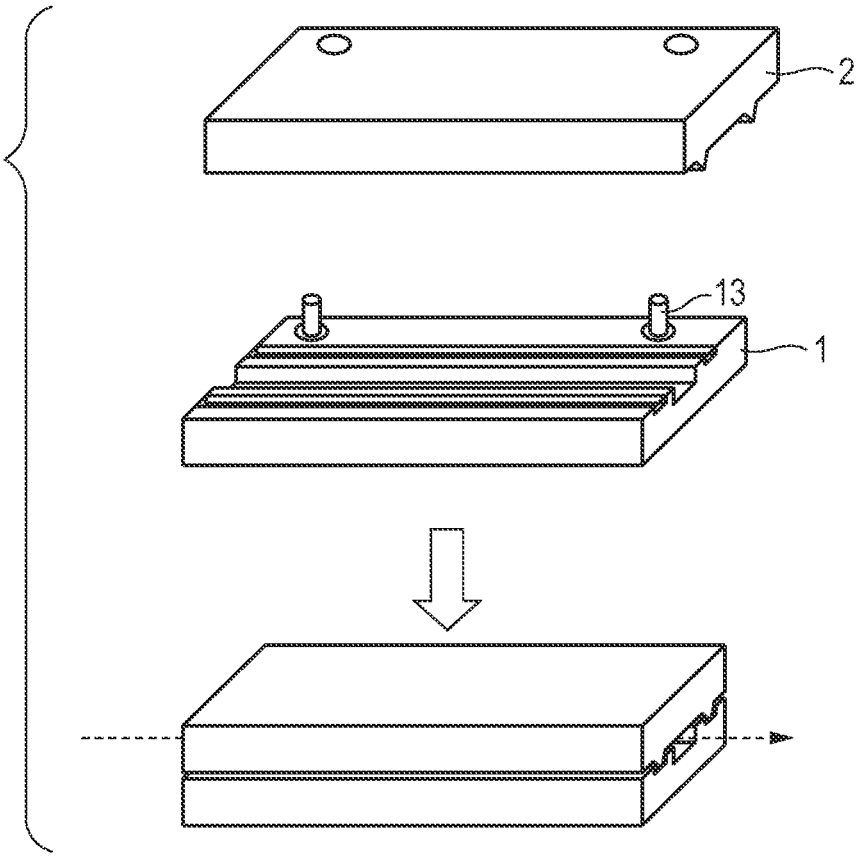
FIG. 6 is a schematic perspective view of a fluid path structure according to the present invention, illustrating how it is prepared by assembling its parts.

The profile of the hole 22 is not limited to the one illustrated in FIGS. 1A and 1B. The holes 22 may alternatively have a profile as illustrated in FIG. 5. FIG. 5 is a schematic cross-sectional view of another embodiment of fluid path structure, representing the aligning section thereof. As compared with the embodiment of FIGS. 1A and 1B, the gap between the projection 113 and the hole 222 is gradually reduced from the tip toward the base of the projection in the embodiment of FIG. 5. Thus, as a result, the hole 222 of the embodiment of FIG. 5 provides an effect of eliminating the step on the inner peripheral wall of the hole 22 of the embodiment of FIGS. 1A and 1B where the wall thickness is reduced. With this arrangement, the two weld members can be welded without producing any cracks and fissures in the inside of the material that can otherwise be produced particularly due to the influence of vibrations at the time of ultrasonic welding.

The description of the first embodiment will now be resumed by referring back to FIGS. 1A and 1B. FIG. 1B is a schematic cross-sectional view of the fluid path structure produced by joining the first weld member 1 and the second weld member 2. As illustrated in FIG. 1B, when the weld member 1 and the weld member 2 are joined together, two welding zones 14 are produced at positions where the two ribs 21 are made to meet the respective welding grooves 12 and a fluid path 15 is formed between the two welding zones 14.

Additionally, as the weld member 1 and the weld member 2 are joined together, the projection 13 is put into the holes 22 and the lateral surface of the projection 13 is made to partially contact with the lateral surface of the hole 22 at the base side of the projection relative to a half of the height of the hole 22. In other words, a portion of the lateral surface of the projection 13 and a corresponding portion of the lateral surface of the hole 22 that are located at the base side at positions lower in height than a half of the height of the hole become their contact portions.

Now, the welding method for assembling the weld members to produce a fluid path structure as illustrated in FIGS. 1A and 1B will be described below. FIGS. 2A through 2D are cross-sectional views of the weld members, illustrating the flow of the welding method.

Figure 2A:
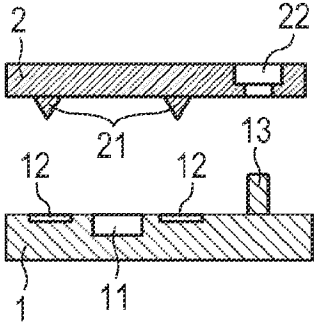
FIGS. 2A, 2B, 2C and 2D are schematic cross-sectional views of the fluid path structure of FIGS. 1A and 1B, illustrating the welding method for forming a fluid path structure according to the present invention.

FIG. 2A is a schematic cross-sectional view of the weld members, illustrating how the second weld member 2 is aligned on and with the first weld member 1. Ultrasonic welding is applied to the welding method of this embodiment. Firstly, the first weld member 1 is rigidly secured to a welding jig (not illustrated) and the second weld member 2 is arranged on the first weld member 1. At this time, the two members are aligned with each other by bringing the projection 13 formed on the first weld member 1 into engagement with the hole 22 formed in the second weld member 2.

The gap between the two members at the above-described contact portions is required to represent a degree of accuracy within the allowable welding position accuracy limit. For this reason, according to the present invention, the gap between the projection 13 and the hole 22 is narrowed and minimized at the base side of the projection relative to a half of the height of the hole 22.

Besides, the projection 13 comes to represent slight lateral deflection, starting from the base thereof, when it is subjected to ultrasonic vibrations. Therefore, the projection 13 is preferably welded to the lateral wall of the hole 22 at a position located close to the base of the projection 13 where the deflection is relatively small in order to weld them and the contact area of the contact portions is desirably made as small as possible so that the welding operation may represent a degree of accuracy within the allowable welding position accuracy limit.

Figure 9:
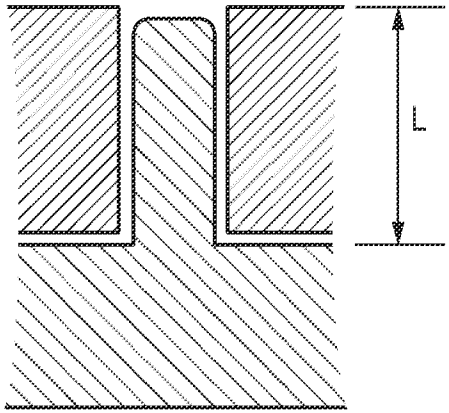
FIG. 9 is a table representing the relationship between the height of the contact portion relative to the height of the hole and the degree of deflection of the projection.

FIG. 9 is a table representing the relationship between the height of the contact portions relative to the height of the hole 22 and the degree of deflection of the projection 13. In the table, A and B denote high ratings to be given to small degrees of deflection, meaning that the two weld members 1 and 2 do not contact with each other in any area other than the welding zones, while C denotes a rating to be given to a critical degree of deflection at which the two weld members 1 and 2 may or may not contact with each other and D denotes a rating to be given to a degree of deflection at which the two weld members 1 and 2 inevitably contact with each other at one or more than one position.

The tendency illustrated in FIG. 9 with regard to the relationship between the height of the contact portions relative to the height of the hole 22 and the degree of deflection of the projection 13 is qualitatively stable and invariable, although the exact relationship may vary depending on the resin material and the profile of the projection. In this embodiment, modified PPE+PC resin (mixture resin of modified polyphenylene ether and polycarbonate) is employed as resin material of the weld members 1 and 2 and the projection 13 is made to have a height of 4.8 mm and a diameter Φ of 3.0 mm.

As described above, the aligning means (at the aligning position) for the two weld members 1 and 2 is characterized in that it consists in only partial contact of the lateral surface of the projection 13 and the lateral surface of the hole 22 and the partial contact area is located at the base side of the projection relative to a half of the height of the hole 22.

Figure 2B:
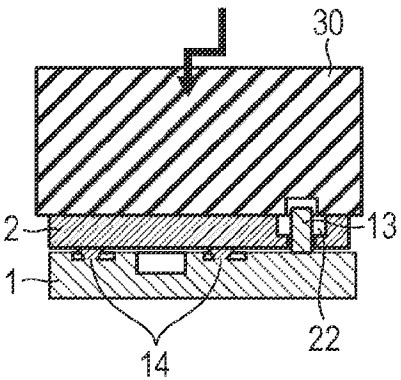

FIG. 2B is a schematic cross-sectional view of the weld members that are being welded by ultrasonic welding.

Known ultrasonic welding techniques include one to be executed by arbitrarily specifying the penetration amount (mm) that defines the amount by which the ultrasonic welding horn is moved during ultrasonic oscillation, one to be executed by arbitrarily specifying the length of time (second) for which ultrasonic energy is transmitted to the object to be welded and one to be executed by arbitrarily specifying the amount per unit time of energy (joule: the number of watts per second) to be transmitted to the object to be welded.

The ultrasonic welding technique that is to be executed by specifying the penetration amount (mm) is selected for this embodiment so that ultrasonic waves may reliably penetrate into the contact area in order to avoid any liquid leakage from taking place after the welding.

With ultrasonic welding, vibrations are applied to the joint surfaces in the direction perpendicular to the joint surfaces. As illustrated in FIG. 2B, the welding zones 14 are fused by the vibrations transmitted through the second weld member 2 by way of horn 30 and further to the front ends of the ribs 21 and also by the applied pressure. The horn 30 is moved by the amount that is specified in advance and then the application of ultrasonic waves is terminated.

Figure 2C:
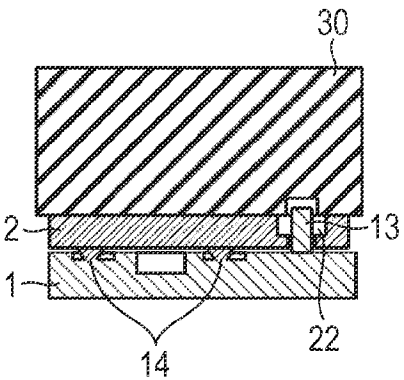

FIG. 2C is a schematic cross-sectional view of the weld members that are being cooled after the termination of the application of ultrasonic waves in the state where the second weld member 2 is pressed against the first weld member 1 by the horn 30. Since the state of being pressed is maintained until the resin material at the welding zone 14 is cooled after the termination of the application of ultrasonic waves as described above in the ultrasonic welding operation, the ultimate penetration amount will become slightly greater than the specified penetration amount.

Figure 2D:
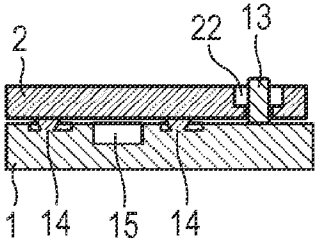

FIG. 2D is a schematic cross-sectional view of the weld members after the completion of the ultrasonic welding operation. As a result of the above-described ultrasonic welding operation, the two welding zones 14 are turned into two welded sections 14 and a fluid path 15 that is to operate as ink channel is formed between them. The projection 13 and the hole 22 that operate as means for aligning the first weld member 1 and the second weld member are so arranged that the gap between the projection 13 and the hole 22 is narrowed and minimized at a position located at the base side of the projection relative to a half of the height of the hole 22. The lateral wall of the projection and that of the hole may contact each other at that position. The contact area is preferably as small as possible in order to avoid any loss of vibration energy during the ultrasonic welding operation. Therefore, point contact is preferable to surface contact.

Figure 3A:
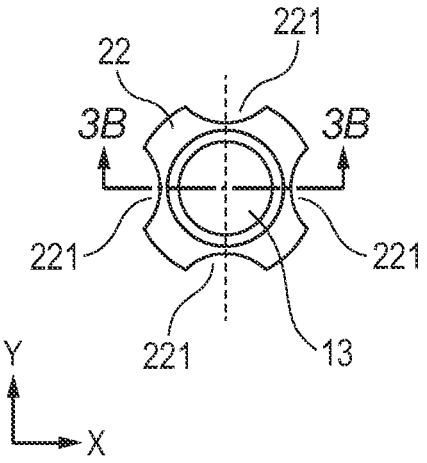
FIGS. 3A and 3B are schematic illustrations of an exemplar aligning hole formed according to the present invention.
Figure 3B:
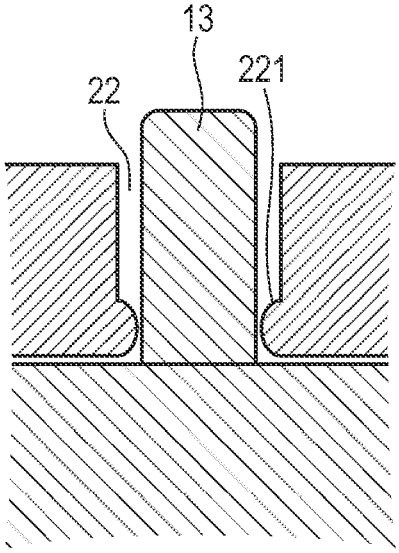

Alternatively, a plurality of curved projections 221 as illustrated in FIGS. 3A and 3B may be arranged in the hole 22 as a narrowing section for narrowing and minimizing the gap between the projection 13 and the hole 22. For the purpose of the present invention, the expression of "a curved projection" means that the front end facet of a projection represents a convex profile with a certain radius of curvature. FIG. 3A is a schematic plan view of the hole 22 as viewed in the running direction (Z-direction) of the hole 22 and FIG. 3B is a schematic cross-sectional view taken along line 3B-3B in FIG. 3A. As illustrated in FIGS. 3A and 3B, the curved projections 221 preferably have a profile that brings them into not surface contact but point contact with the lateral surface of the projection 13.

Figure 4A:
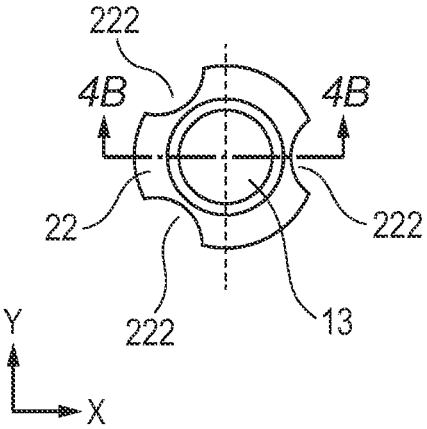
FIGS. 4A and 4B are schematic illustrations of another exemplar aligning hole formed according to the present invention.
Figure 4B:
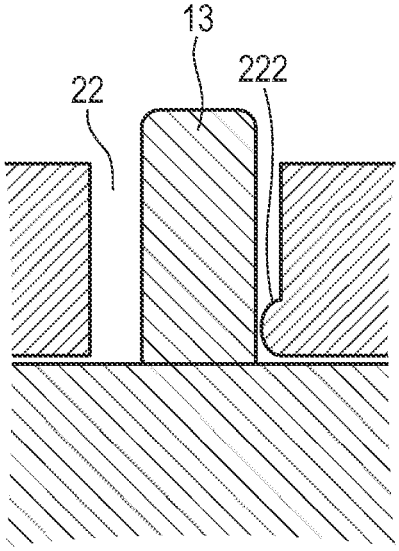

As for the number and the positions of curved projections 221, for example, four curved projections may be arranged on the lateral surface of the hole 22 at regular intervals in the circumferential direction that is perpendicular to the axial direction of the hole 22 as illustrated in FIGS. 3A and 3B. With this arrangement, the welding positions can be controlled in terms of the X- and Y-directions that are perpendicular to each other. More preferably, three curved projections 221 may be arranged on the lateral surface of the hole 22 at regular intervals in the circumferential direction as illustrated in FIGS. 4A and 4B. With this arrangement, the welding positions can be controlled in terms of the X- and Y-directions with a smaller number of curved projections if compared with the arrangement of FIGS. 3A and 3B.

While means for narrowing the gap between the projection 13 and the hole 22 is arranged in the hole 22 with the arrangement of FIGS. 3A and 3B and with that of FIGS. 4A and 4B, the present invention is by no means limited to such arrangements. For example, a narrowing section similar to above-described ones (not illustrated) may alternatively be arranged on the peripheral surface of the projection 13.

Thus, with the above-described welding technique, the weld member 1 and the weld member 2 can easily and accurately be aligned with each other and welded to each other without allowing contact of any parts thereof other than the welding zones that can interfere with the welding operation.

For example, if a first weld member 100 has a wall as illustrated in area A in FIG. 5, two weld members 100 and 200 can easily be aligned with each other without allowing the wall surface of the first weld member 100 and the lateral surface of the second weld member 200 to contact with each other.

As described above, the influence of deflection of the projection 13 during the ultrasonic welding process can be minimized by aligning the first weld member and the second weld member by bringing the projection 13 that is arranged on the first weld member 1 and the hole 22 that is arranged in the second weld member 2 into mutual engagement and making them contact with each other in a partial contact area that is located at the base side of the projection relative to a half of the height of the hole 22. Then, therefore, the two weld members can be welded to each other within the allowable positional accuracy without allowing contact of any parts thereof other than the welding zones 14. Furthermore, the vibration energy can be concentrated to the welding zones 14 for welding without any significant loss of energy.

Thus, the present invention provides a method of manufacturing a fluid path structure, in which the related parts thereof in the welding zones are excellently welded and which is made to be free from liquid leakage.

Second Embodiment

Now, the second embodiment of the present invention will be described below.

Figure 7:
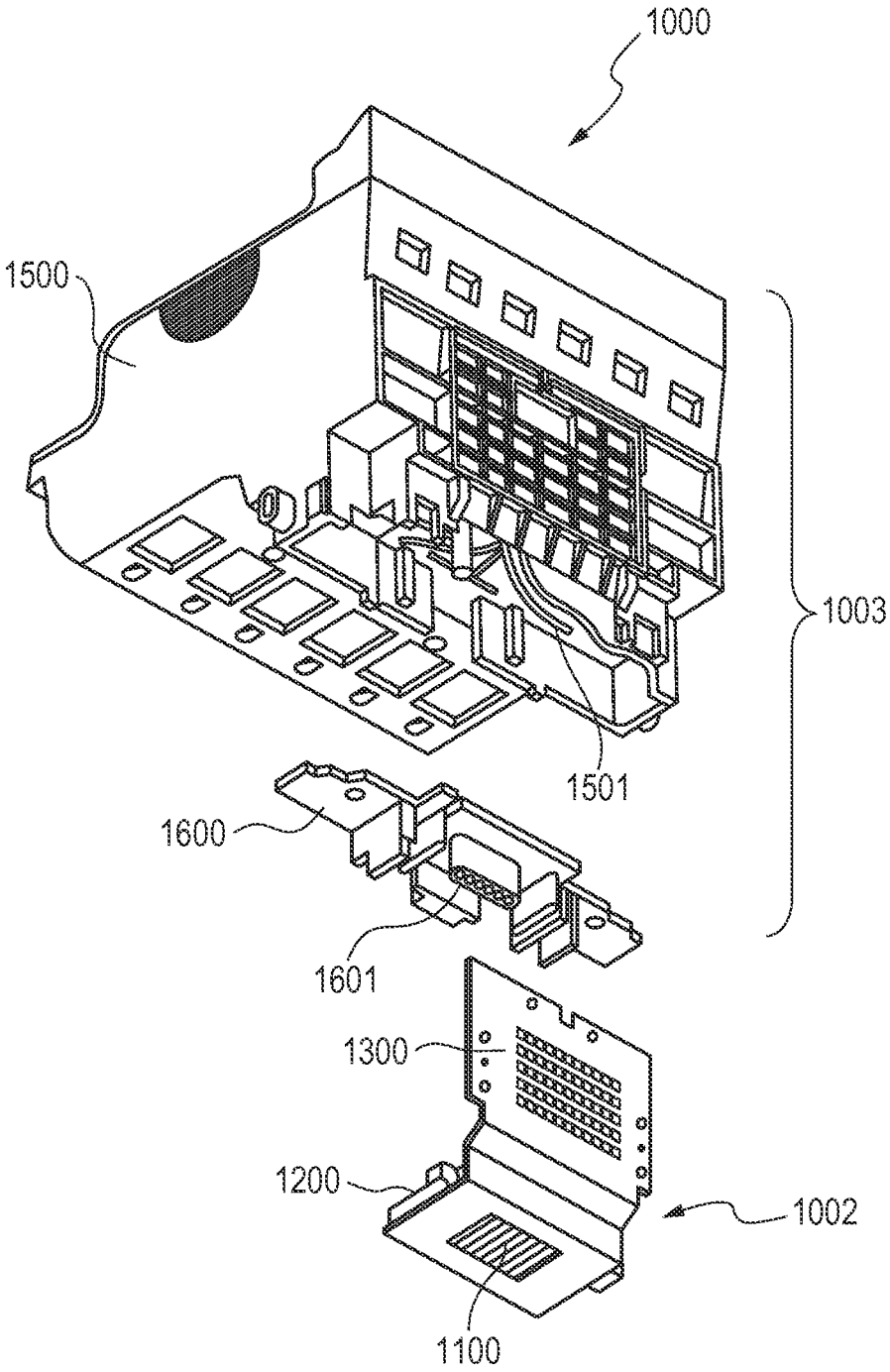
FIG. 7 is an exploded schematic perspective view of an inkjet head including a fluid path structure according to the present invention.

FIG. 7 illustrates the basic configuration of inkjet head 1000 that is a liquid ejection head including a fluid path structure according to the present invention. The inkjet head 1000 includes a recording element unit 1002 that includes a recording element board 1100 and an electric wiring board 1300 and a holder unit 1003.

The recording element board 1100 is formed by using a silicon board having openings that operate as ink supply ports and a plurality of heat-generating resistors are arranged on the board in order to apply thermal energy to ink as thermal energy is required to eject liquid. Such a board on which heat-generating resistors are formed is referred to as a heater board. A heater board is provided with wiring for supplying electric power to the heat-generating resistors and electrically connected to the electrode pads arranged at the opposite ends of the board by means of the wiring. A complete recording element board 1100 is formed by bonding an ejection port forming member having a plurality of ejection ports onto the heater board. Note, however, that the applicable scope of the present invention is by no means limited to liquid ejection heads that employ heat-generating resistors, but includes those that include a recording element board having an energy-generating means for generating energy (e.g., heat, vibrations, static electricity, etc.) to be used for causing ink to be ejected from ejection ports.

Wiring for supplying electric power to the heat-generating resistors on the heater board is arranged on the electric wiring board 1300. The recording element board 1100 and the electric wiring board 1300 are highly accurately joined to holding member 1200 by adhesion and supported by the latter. Additionally, the recording element board 1100 and the electric wiring board 1300 are electrically joined to each other by means of a TAB mounting technique and the joint parts thereof are hermetically sealed by means of a sealing material.

Figure 8A:
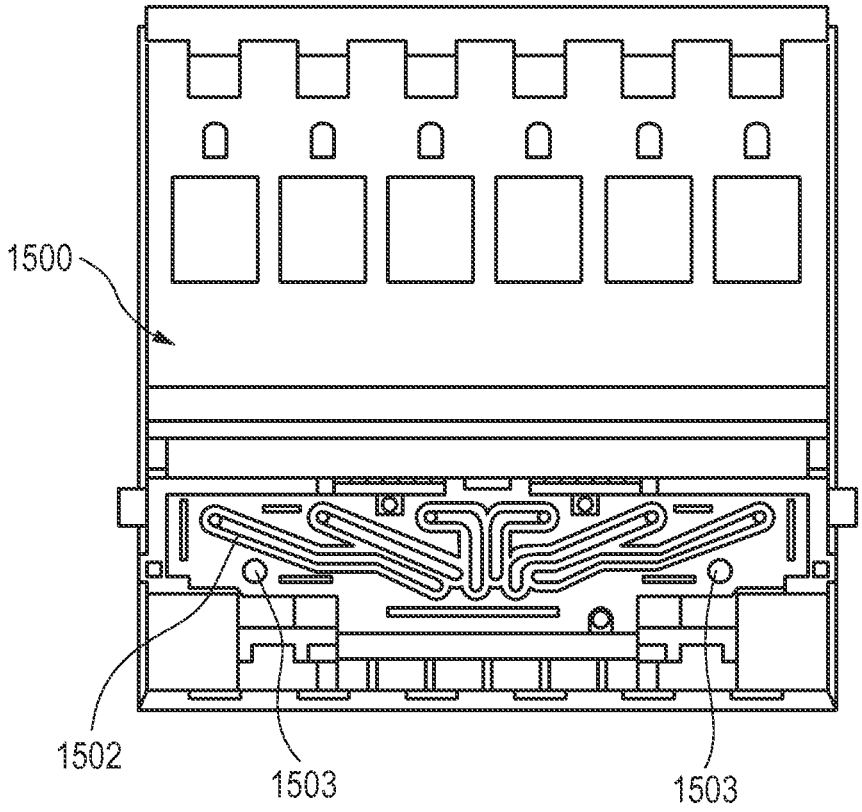
FIGS. 8A and 8B are schematic illustrations of the surface to be welded of a fluid path forming member and that of a holder that the inkjet head as illustrated in FIG. 7 includes.
Figure 8B:
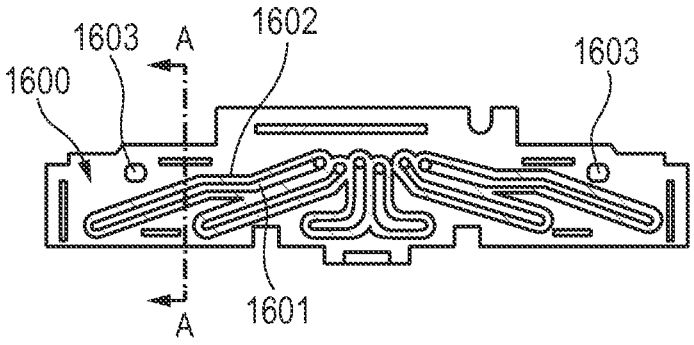

FIGS. 8A and 8B are schematic illustrations of the joint surfaces at the time of welding operation for forming an inkjet head shown in FIG. 7. FIG. 8A illustrates the joint surface of holder 1500 that is to be joined to fluid path forming member 1600 and FIG. 8B illustrates the joint surface of the fluid path forming member 1600 that is to be joined to the holder 1500.

The holder 1500 is a member that corresponds to the above-described first weld member 1 and includes welding grooves 1502 and projections 1503 that operate as alignment pins.

The fluid path forming member 1600 is a member that corresponds to the above-described second weld member and includes groove-shaped ink paths 1601 having a profile same as that of the welding grooves 1502, welding ribs 1602 extending along the peripheral edges of the ink paths 1601 and alignment holes 1603 into which the projections 1503 are to be inserted respectively.

The holder unit 1003 that is a fluid path structure according to the present invention is formed by joining the holder 1500 and the fluid path forming member 1600 by ultrasonic welding. With regard to alignment of the holder 1500 and the fluid path forming member 1600, the contact portions thereof are preferably found near the base of the projection 1503 and the contact area of the contact portions thereof is preferably as small as possible.

As described above, the present invention is applicable to holder units that operate as ink paths of popular inkjet heads. The present invention provides a method of welding and joining a holder and a fluid path forming member for a holder unit, aligning them by bringing the projections 1503 of the holder 1500 and the corresponding respective holes 1603 of the fluid path forming member 1600 into partial contact at the contact portions thereof, which operate as aligning means and are located at the base side relative to a half of the height of the projections 1503. With this method, the base side of the projections 1503 is less influenced by deflection during the ultrasonic welding process so that the welding process can be executed within the allowable limit for welding accuracy.

Thus, the resin parts do not contact each other except the welding zones (the joining sections at the front ends of the welding ribs 1602 and the peripheral edges of the welding grooves 1502) so that vibration energy can be concentrated to the welding zones for welding without any significant loss of energy. In this way, the present invention provides a method of manufacturing a fluid path structure in which the related parts thereof are excellently welded and which is free from liquid leakage.

While the present invention is applied to an inkjet head in this embodiment, the present invention is by no means limited to inkjet heads and provides a method of highly accurately aligning resin members and welding them in an excellent manner.

Additionally, for aligning and welding two weld members, one or more than one projection (13, 1503) is arranged at one of the weld members (1, 1500), and one or more than one hole, whichever appropriate, is arranged at the other member (2, 1603) in the above-described embodiments. However, the present invention is by no means limited to such an arrangement and is also applicable to instances where one or more than one hole is arranged at the former weld member and one or more than one projection, whichever appropriate, is arranged at the latter weld member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-118856, filed Jun. 5, 2013, which is hereby incorporated by reference herein in its entirety.

What is claimed is:

1. A method of manufacturing a fluid path structure, comprising:

a preparation step of preparation of a first resin part having a groove and a projection formed on a first surface of the first resin part and a second resin part having a rib formed on a first surface of the second resin part and a through-hole formed in the second resin part penetrating from the first surface of the second resin part to an opposite second surface of the second resin part;

an aligning step of aligning the first surface of the first resin part with the first surface of the second resin part by facing the first surfaces to one another so that the rib contacts with the groove by inserting the projection into the through-hole; and a welding step of welding joint surfaces of the rib and the groove that have been aligned, forming a fluid path, the aligning step being executed so as to narrow the gap between the projection and the through-hole to a minimum at a base side of the projection relative to a half of the height of the through-hole, and the welding step being executed only at the base side of the projection relative to the half of the height of the through-hole so as to make a lateral surface of the projection only partially contact with a lateral surface of the through-hole.

2. The method according to claim 1, wherein the gap is gradually reduced from the tip toward the base of the projection.

3. The method according to claim 1, wherein the through-hole or the projection is provided with a narrowing section for narrowing the gap.

4. The method according to claim 3, wherein the narrowing section includes a plurality of curved projections formed on the lateral surface of the through-hole or the lateral surface of the projection.

5. The method according to claim 1, wherein the welding step is executed by means of ultrasonic welding.

6. A method of manufacturing a fluid path structure, comprising:

a preparation step of preparation of a first resin part having a groove and a projection formed on a first surface of the first resin part and a second resin part having a rib formed on a first surface of the second resin part and a through-hole formed in the second resin part penetrating from the first surface of the second resin part to an opposite second surface of the second resin part;

an aligning step of aligning the first surface of the first resin part with the first surface of the second resin part by facing the first surfaces to one another so that the rib contacts with the groove by inserting the projection into the through-hole; and a welding step of welding joint surfaces of the rib and the groove that have been aligned, thereby forming a fluid path, the aligning step being executed so as to narrow the gap between the projection and the through-hole to a minimum at a base side of the projection relative to a half of the height of the through-hole.

7. The method according to claim 6, wherein in the welding step, a contact portion where a base side of the projection contacts with the through-hole is welded.

8. The method according to claim 6, wherein a tip of the projection and the though-hole do not contact each other.

* * * * *